US006741013B2

(12) United States Patent
Dakin et al.

(10) Patent No.: US 6,741,013 B2
(45) Date of Patent: May 25, 2004

(54) SHROUDED ELECTRIC LAMP HAVING FUNCTIONALLY DISTINGUISHABLE CENTER SUPPORTS

(75) Inventors: James Thomas Dakin, Shaker Heights, OH (US); Mark Elton Duffy, Shaker Heights, OH (US); Curtis Edward Scott, Mentor, OH (US)

(73) Assignee: General Electric Company, Schenectady, NY (US)

( * ) Notice: Subject to any disclaimer, the term of this patent is extended or adjusted under 35 U.S.C. 154(b) by 294 days.

(21) Appl. No.: 09/736,060

(22) Filed: Dec. 13, 2000

(65) Prior Publication Data

US 2002/0070644 A1 Jun. 13, 2002

(51) Int. Cl.[7] ..... H01J 1/02
(52) U.S. Cl. ..... 313/25; 313/634
(58) Field of Search ..... 313/25–26, 634–635, 313/13, 17, 27, 47, 492, 493, 624–626, 637, 638, 639, 642, 643

(56) References Cited

U.S. PATENT DOCUMENTS

| | | | | |
|---|---|---|---|---|
| 4,161,672 | A | | 7/1979 | Cap et al. |
| 4,281,274 | A | | 7/1981 | Bechard et al. |
| 4,499,396 | A | | 2/1985 | Fohl et al. |
| 4,721,876 | A | | 1/1988 | White et al. |
| 4,935,668 | A | | 6/1990 | Hansler et al. |
| 4,950,938 | A | | 8/1990 | Ramaiah |
| 5,023,506 | A | | 6/1991 | Canale et al. |
| 5,043,623 | A | | 8/1991 | Scholz et al. |
| 5,065,069 | A | | 11/1991 | Hunter |
| 5,075,588 | A | | 12/1991 | Hunter |
| 5,122,706 | A | | 6/1992 | Parrott et al. |
| 5,252,885 | A | | 10/1993 | Muzeroll et al. |
| 5,270,608 | A | | 12/1993 | Williamson et al. |
| 5,296,779 | A | | 3/1994 | Muzeroll |
| 5,334,906 | A | | 8/1994 | Muzeroll |
| 5,340,346 | A | | 8/1994 | Muzeroll |
| 5,493,167 | A | | 2/1996 | Mikol et al. |
| 5,550,421 | A | | 8/1996 | Scholz et al. |
| 5,576,592 | A | | 11/1996 | Koenigsberg et al. |
| 5,610,469 | A | | 3/1997 | Bergman et al. |
| 5,719,463 | A | | 2/1998 | Hassink et al. |
| 5,998,915 | A | * | 12/1999 | Scholz et al. ..... 313/234 |
| 6,242,851 | B1 | * | 6/2001 | Zhu et al. ..... 313/25 |

* cited by examiner

*Primary Examiner*—Jay Patidar
(74) *Attorney, Agent, or Firm*—Fay, Sharpe, Fagan, Minnich & McKee, LLP

(57) ABSTRACT

An electric lamp (100) including a sealed light-transmissive lamp envelope (105) having an interior space, a base fixed to the outer envelope (105), a non-insulated main conductor wire (160) within the outer envelope and connected to the base (110) at one end, a light source (140) capable of generating light within the outer envelope (105), a shroud (145) surrounding the light source (140) and mounted adjacent the non-insulated main conductor wire (160), and a first center support. The light source (140) has first and second ends. The first end is electrically coupled to the non-insulated main conductor wire (160), and the second end is coupled to a stem lead (180). The first center support (150) supports the shroud (145) and the light source (140) and mechanically couples the shroud (145) and the light source (140) to the non-insulated main conductor wire (160).

16 Claims, 4 Drawing Sheets

SHROUDED ELECTRIC LAMP HAVING FUNCTIONALLY DISTINGUISHABLE CENTER SUPPORTS

BACKGROUND OF THE INVENTION

1. Field of the Invention

This application relates to electric lamps and in particular, to electric lamps having shrouds.

2. Discussion of the Art

Metal halide arc discharge lamps are frequently employed in commercial usage because of their high luminous efficacy and long life. A typical metal halide arc discharge lamp includes a quartz or ceramic arc tube that is hermetically sealed within a glass jacket or outer envelope. The arc tube, itself hermetically sealed, has tungsten electrodes frit or press sealed in opposite ends and has a bulb portion containing fill material including mercury, metal halide additives, and a rare or noble gas to facilitate starting. The outer envelope is either evacuated or filled with nitrogen or another inert gas at less than atmospheric pressure.

The metal halide arc tube is often surrounded with a shroud which comprises a generally cylindrical tube of light-transmissive material, such as quartz, that is able to withstand high operating temperatures. The arc tube and the cylindrical shroud are coaxially mounted within the lamp outer envelope with the arc tube located within the shroud. The shroud improves the safety of the lamp by acting as a containment device in the event that the arc tube shatters. The shroud allows the lamp outer envelope to remain intact by dissipating the energy of a shattering arc tube. The presence of a shroud expands the market for metal halide lamps into open-type (absence of an expensive cover plate) lighting fixtures.

Sodium is an important constituent in metal halide arc discharge lamps, usually in the form of sodium iodide. Sodium is used to improve the efficacy and color rendering properties. It has long been recognized that quartz arc tubes containing sodium lose sodium during operation by movement or migration through the arc tube wall. The iodine originally present in a metal halide arc discharge lamp as sodium iodide is freed by sodium loss, and the iodine combines with mercury in the arc tube to form mercury iodide. Mercury iodide leads to increased reignition voltages, thereby causing starting and lamp maintenance problems and shortening lamp life.

There is evidence that most of the sodium loss is due to a negative charge on the arc tube walls caused by photoelectric emission from electrified side rods used to support the arc tube and shroud within the outer envelope. Solutions to this problem are known in the art. See, for example, U.S. Pat. No. 5,493,167, where a ceramic sleeve and insulator support stops are used to prevent sodium loss. While such lamp constructions provide an improvement, the structures are complex and still require a relatively high number of parts and/or welds, making them difficult to assemble.

Accordingly, a need exists for a more efficient lamp construction.

BRIEF SUMMARY OF THE INVENTION

In accordance with the present invention, the improved electric lamp includes a sealed light-transmissive outer envelope having an interior space, a base fixed to the outer envelope, a non-insulated main conductor wire within the outer envelope and connected to the base at one end, a light source capable of generating light within the outer envelope, a shroud surrounding the light source and mounted adjacent the non-insulated main conductor wire, and a first center support. The light source has first and second ends. The first end is electrically coupled to the non-insulated main conductor wire, and the second end is coupled to a stem lead. The first center support supports the shroud and the light source and mechanically couples the shroud and the light source to the non-insulated main conductor wire.

DETAILED DESCRIPTION OF THE INVENTION

Figure 1:
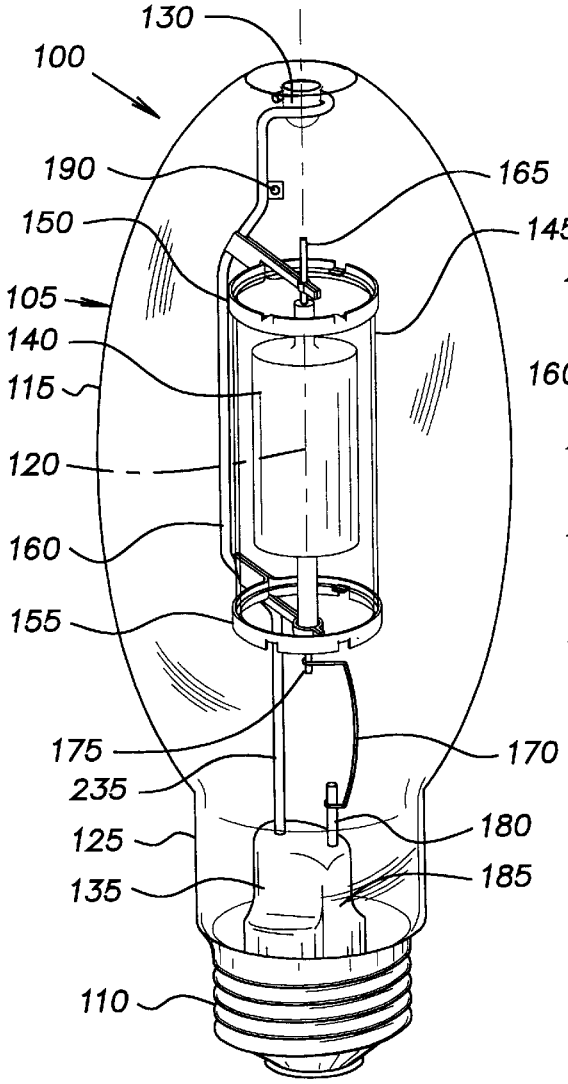
FIG. 1 shows a perspective view of an electric lamp according to the present invention.

An electric lamp or electric lamp assembly 100 in accordance with a preferred embodiment of the invention is shown in FIG. 1. The electric lamp 100 is a metal halide arc discharge lamp and includes a bulb or outer envelope 105 and a base 110. The outer envelope 105 has a main or dome region or portion 115 elongated along a central lamp axis 120 and a neck region or portion 125. The dome portion 115 may also be a cylindrical or tubular extension of the neck portion 125 terminating in a rounded top. The dome portion 115 preferably has a dimple 130 along the central lamp axis 120 at the upper end of the outer envelope 105 (as viewed). The neck portion 125 has an inside diameter generally perpendicular to the central lamp axis 120. The outer envelope 105 is typically formed of a blow molded hard glass such as borosilicate. The base 110 includes a glass stem 135, which is hermetically sealed to the outer envelope 105. The glass stem 135 extends into the neck portion 125 along the central lamp axis 120. The base 110, formed for easy connection to an electrical source, is fixed to the outer envelope 105.

Contained within the interior space of the outer envelope 105 is a mount assembly. The mount assembly includes a light source, lamp capsule, or arc tube 140, a shroud 145, an upper center support 150, a lower center support 155, and a first or non-insulated main conductor wire 160. The non-insulated main conductor wire 160 is electrically conductive and is not surrounded by an insulative material, such as a sleeve.

Figure 2:
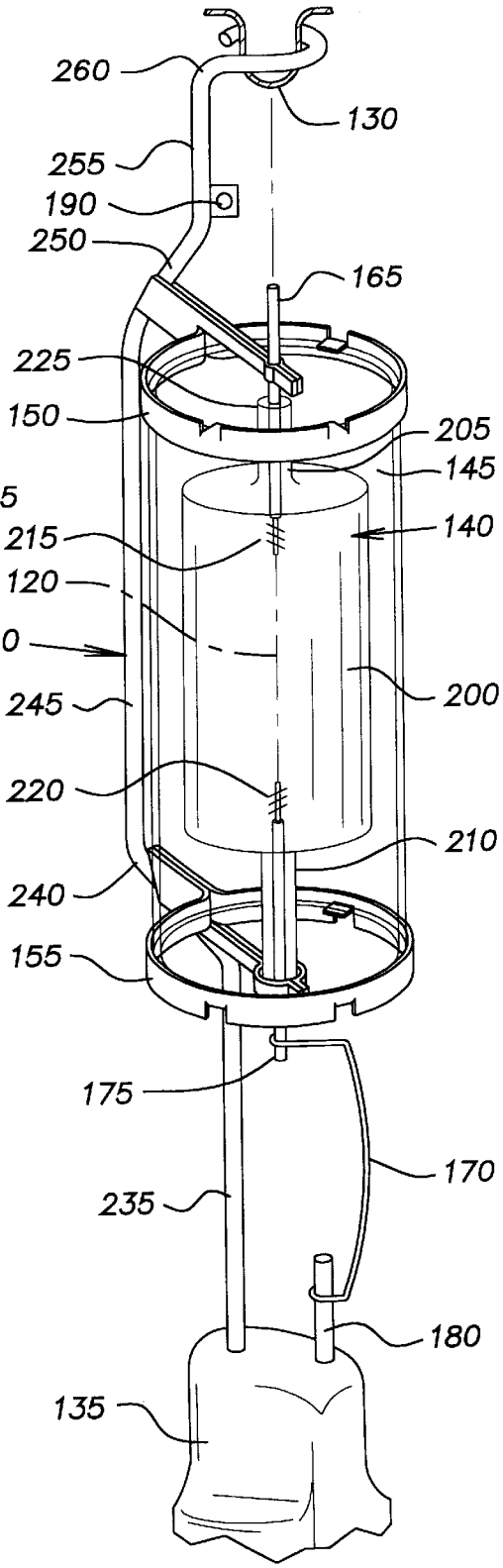
FIG. 2 shows a perspective view of the mount assembly used in the electric lamp of FIG. 1.

As shown in FIGS. 1 and 2, the upper center support 150 supports the shroud 145 and the arc tube 140 and mechanically couples the shroud 145 and the arc tube 140 to the non-insulated main conductor wire 160. Further, the upper center support 150 electrically connects the non-insulated main conductor wire to a first or upper electric or electrode lead 165 of the arc tube 140, and a second conductor wire 170 couples a second or lower electric or electrode lead 175 of the arc tube 140 to an electrical conductor or stem lead 180. The non-insulated main conductor wire 160 and the stem lead 180 pass through the stem 135 and are sealed by a stem press 185 as is known in the art. Alternatively, the non-insulated main conductor wire 160 may be coupled to a second stem lead which passes through the stem 135. As shown in FIG. 1, the non-insulated main conductor wire 160 and the stem lead 180 are electrically connected to the base 110 external of the outer envelope 105 to provide access for energization of the lamp.

As is well known, getters are important in any structure wherein an evacuated or inert gas environment is desired. Thus, a getter may be positioned within the outer envelope 105. For example, a zirconium aluminum getter 190 may be positioned within and at the upper end of the outer envelope 105 (as viewed) generally between the top end of the shroud 145 and the dimple 130. A second embodiment of a getter will be discussed below.

FIG. 2 shows an enlarged view of the mount assembly. The arc tube 140 is disposed substantially within an interior space or cavity of the shroud 145. The arc tube 140 includes a bulb portion 200 and upper and lower leg portions 205 and 210. Contained within the arc tube 140 are two electrodes 215 and 220 located at opposite ends of the bulb portion 200 and attached to the upper and lower electrode leads 165 and 175 which extend through the upper and lower leg portions 205 and 210, respectively. Frit seals 225 are located opposite the upper and lower electrode ends of the bulb portion 200 and seal the upper and lower electrode leads 165 and 175 to provide sealed electrical feed-throughs to the electrodes 215 and 220. The bulb portion 200, which encloses a sealed discharge region which contains a suitable fill material for maintaining an arc discharge, is disposed within the interior cavity of the shroud 145. It will be noted that in other types of lamp assemblies, the lamp capsule may be of a different configuration. For example, instead of two electrodes 215 and 220, there may be a filament. Additionally, the frit seals 225 may instead be pinch or press seals.

Preferably, the arc tube 140 is of a cylindrical design. Alternatively, the arc tube may be of an ellipsoidal design such as is disclosed in U.S. Pat. No. 4,161,672, the disclosure of which is expressly incorporated herein in its entirety. The ellipsoidal design does not require the inside diameter of the shroud 145 to be in close proximity of the outside diameter of the arc tube 140 for suitable performance.

It will be noted that the arc tube 140 of the preferred embodiment is a ceramic metal halide arc tube made of a high temperature ceramic material, such as alumina ceramic. This material is useful because ceramic arc tubes assist in suppressing sodium loss. However, the light source 140 may also be a tungsten halogen incandescent lamp or other lamp which is advantageously operated with a shroud.

The shroud 145 is preferably a cylindrically-shaped tube having two ends which are open to an interior space, cavity or zone. Preferably, the shroud 145 is made of a light-transmissive and heat-resistant material, such as fused quartz. The shroud 145 is supported within the outer envelope 105 generally coaxial with the arc tube 140. The shroud 145 preferably has a length about the same as the distance between the outer ends of the arc tube frit seals 225 and less than the distance between the outer ends of the upper and lower electrode leads 165 and 175. This length is typically about 82 mm. The shroud 145 typically has a wall thickness of about 2.5 mm, and preferably between about 1.5 mm and about 2.5 mm. The distance between the shroud 145 and the arc tube 140 is typically about 4.5 mm. The shroud 145 must have an inner diameter greater than the outer diameter of the arc tube bulb portion 200. The inner diameter of the shroud is typically about 30 mm. Preferably, the shroud 145 has a maximum outer diameter only slightly less than the inner diameter of the outer envelope neck portion 125, that is, the shroud 145 generally has the largest outside diameter that, in combination with the rest of the mount assembly, can be conveniently inserted during manufacturing of the electric lamp 100. This outer diameter is typically about 35 mm.

The upper and lower center supports 150 and 155 center and support the arc tube 140 and the shroud 145 to the non-insulated main conductor wire 160. Together, the upper and lower center supports 150 and 155, the shroud 145, and the arc tube 145 may form an integral unit or a shroud 145 and arc tube 140 subassembly.

As shown in FIG. 1, the shroud is mounted adjacent the non-insulated main conductor wire 160. While the shroud may surround the non-insulated main conductor wire 160, the non-insulated main conductor wire 160 is preferably located outside of the shroud 145, as shown in FIGS. 1 and 2.

The non-insulated main conductor wire 160 has a bottom axial portion 235 parallel to the outer envelope central lamp axis 120 that extends through the stem 135. Connected to the bottom axial portion is a slanted outward portion 240, which extends at approximately a 45 degree angle from the central lamp axis 120. The slanted outward portion is connected to a middle axial portion 245, which extends adjacent the length of the shroud 145 on the outside of the shroud 145. At the top end of the shroud 145, the middle axial portion 245 of the non-insulated main conductor wire 160 becomes a slanted inward portion 250, which extends at approximately a −45 degree angle from the central lamp axis 120. The slanted inward portion 250 is connected to a top axial portion 255. At the end of the top axial portion 255 is preferably an upper terminal loop 260, which generally encircles the dimple 130 of the outer envelope 105 to limit movement of the arc tube 140 and the shroud 145 within the outer envelope 105 and improve rigidity of the entire assembly. The non-insulated main conductor wire 160 is preferably a continuous wire from the stem 135 to the dimple 130.

The non-insulated main conductor wire 160 and the stem lead 180 are coupled to the upper and lower electrode leads 165 and 175 via the upper center support 150 and the second conductor wire 170, respectively. Preferably, the upper and lower center supports 150 and 155 are coupled to the non-insulated main conductor wire 160 at the slanted inward portion 250 and slanted outward portion 240, respectively, to provide additional support for the upper and lower center supports 150 and 155 by reducing the stress on the upper and lower center supports 150 and 155. The upper center support 150 supports the arc tube 140 and the shroud 145 and also electrically connects the upper electrode lead 165 to the non-insulated main conductor wire 160. The lower center support 155 only provides mechanical coupling of the arc tube 140 and the shroud 145 to the non-insulated main conductor wire 160.

In an alternative embodiment, a second stem lead instead of the non-insulated main conductor wire 160 passes through the stem 135. The non-insulated main conductor wire 160 may then be electrically coupled to the second stem lead preferably via welding.

Figure 3:
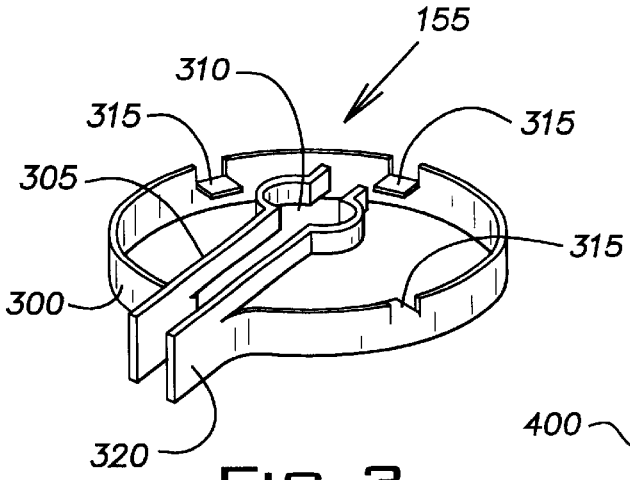
FIG. 3 shows a perspective view of the lower center support used in the electric lamp of FIG. 1.

As seen in FIG. 3, the lower center support 155 is formed of four portions. A circular portion 300 generally engages the lower end of the shroud 145. For example, the circular portion 300 may surround the outer perimeter of the lower end of the shroud 145. An extension portion 305 generally extends from the circular portion 300 and forms a centering hole 310 through which the lower electrode lead 175 and lower leg portion 210 of the arc tube 140 passes. Tab portions or support tabs 315 fold inward and are substantially perpendicular to the circular portion 300. A rectangular portion 320 attaches to the non-insulated main conductor wire 160 and is of sufficient width for welding the lower center support 155 to the non-insulated main conductor wire 160. The upper center support 150 is virtually identical to the lower center support 155. The only difference between the upper and lower center supports 150 and 155 is that the centering hole in the upper center support 150 is of a smaller diameter than the centering hole 310 in the lower center support 155 since only the upper electrode lead 165 passes through the centering hole. The upper and lower center supports 150 and 155 generally position or locate the arc tube 140 coaxially and laterally within the shroud 145. Further, the upper center support 150 acts as an electrical conductor between the upper electrode lead 165 and the base 110. To insure a proper electrical connection, the upper center support 150 may be welded or crimped to the upper electrode lead 165. The upper and lower center supports 150 and 155 are typically made of steel or stainless steel although other electrical conducting elements fall within the scope of the present invention.

Figure 4:
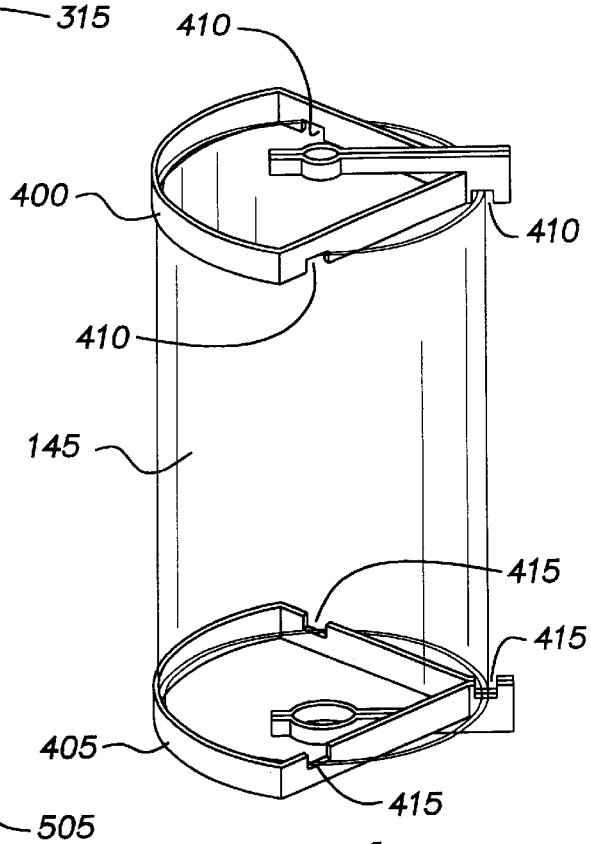
FIG. 4 shows a perspective view of a second embodiment of the center supports used in the electric lamp of FIG. 1.

In a further embodiment of the upper and lower center supports, upper and lower center supports 400 and 405 have notches 410 and 415, respectively, which interconnect with the ends of the shroud 145, as shown in FIG. 4. The notches 410 and 415 and other elements constrain the shroud 145 both radially and axially.

Figure 5:
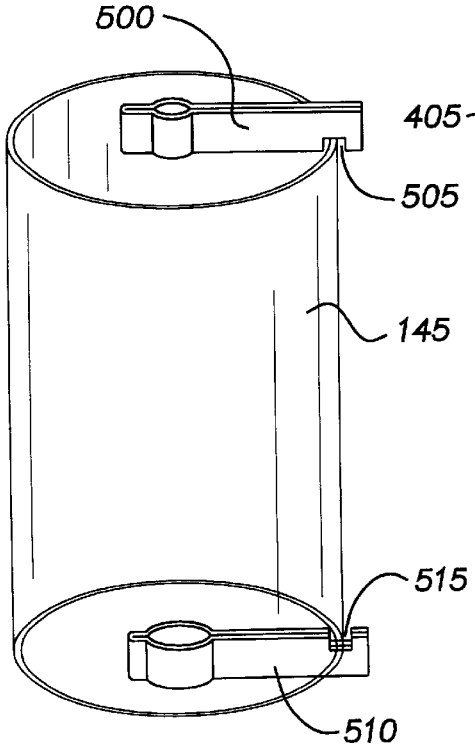
FIG. 5 shows a perspective view of yet another embodiment of the center supports used in the electric lamp of FIG. 1.

FIG. 5 depicts a third embodiment of an upper center support 500. The upper center support 500 is an electrical conducting strip containing two notches 505. The electrical conducting strip 500 bends to surround the upper electrode lead 165 and hold the arc tube 140 in place. A second or lower center support 510 having two notches 515 may surround the lower leg portion 210 of the arc tube 140 for additional support. When the electrical conducting strip 500 is bent around the upper electrode lead 165, the notches 505 line up and appear as a single notch with which the shroud 145 interconnects. Identically, when the lower center support 510 is bent around the lower leg portion 210 of the arc tube 140, the notches 515 line up and appear as a single notch which the shroud 145 interconnects. Each center support 500 or 505 is coupled to the non-insulated main conductor wire 160 using the same manners previously described.

Returning to FIGS. 1 and 2, while it is preferable to employ both the upper and lower center supports 150 and 155, it is noted that only the upper center support 150 is necessary for supporting and centering the arc tube 140 as long as the distance between the stem lead 180 and the second conductor wire 170 is sufficiently small to provide adequate support for the lower end of the arc tube 140. Further, the configuration of the upper and lower center supports 150 and 155 need not be identical. Rather, the configurations of the upper and lower center supports 150 and 155 may differ. For example, the upper center support 150 may be used with the upper electrode lead 165 while the lower center support 510 is used with the lower leg portion 210.

The arc tube 140 and shroud 145 subassembly is manufactured by coaxially mounting the arc tube 140 and the shroud 145. First, the upper center support 150 is placed on one end of the shroud 145. The arc tube 140 is then inserted into the shroud such that the upper electrode lead 165 extends through the centering hole of the upper center support 150. The centering hole is secured to the upper electrode lead 165, preferably via welding, to insure an adequate electrical connection. However, other methods of establishing an electrical connection, such as crimping, may be used. The lower center support 155 is placed on the lower end of the shroud 145 such that the lower electrode lead 175 and lower leg portion 210 of the arc tube 140 extend through the centering hole 310 of the lower center support 155. The lower center support 155 is electrically insulated from the lower electrode lead 175 emanating from the lower leg portion 210 of the arc tube 140. As shown in FIGS. 1 and 2, the lower center support 155 does not make an electrical connection with the lower electrode lead 175 because of the electrical insulating character of the leg portion 210 of the arc tube 140.

In a further embodiment, the lower center support 155 is secured to an electric insulator instead of to the lower leg portion 210 of the arc tube 140. The electric insulator, such as a sleeve, fits over and covers a sufficient portion of the lower electrode lead 175 to prevent an electrical connection between the lower center support 155 and the lower electrode lead 175. The electric insulator may be any electrically insulating material such as a high temperature ceramic. For example, the insulating material may be an aluminum oxide ceramic.

The arc tube 140 and shroud 145 subassembly is then electrically secured to the non-insulated main conductor wire 160 by, for example, welding. This results in securing the shroud 145 in the axial direction. The lower electrode lead 175 is then electrically connected to the stem lead 180 by welding the second conductor wire 170 to the stem lead 180 and the lower electrode lead 175. This connection may also be accomplished by directly connecting the lower electrode lead 175 to the stem lead 180 with a weld. The mount assembly is thereafter inserted into the outer envelope 105 through the inner diameter of the neck portion 125 and sealed to the outer envelope 105.

Figure 6:
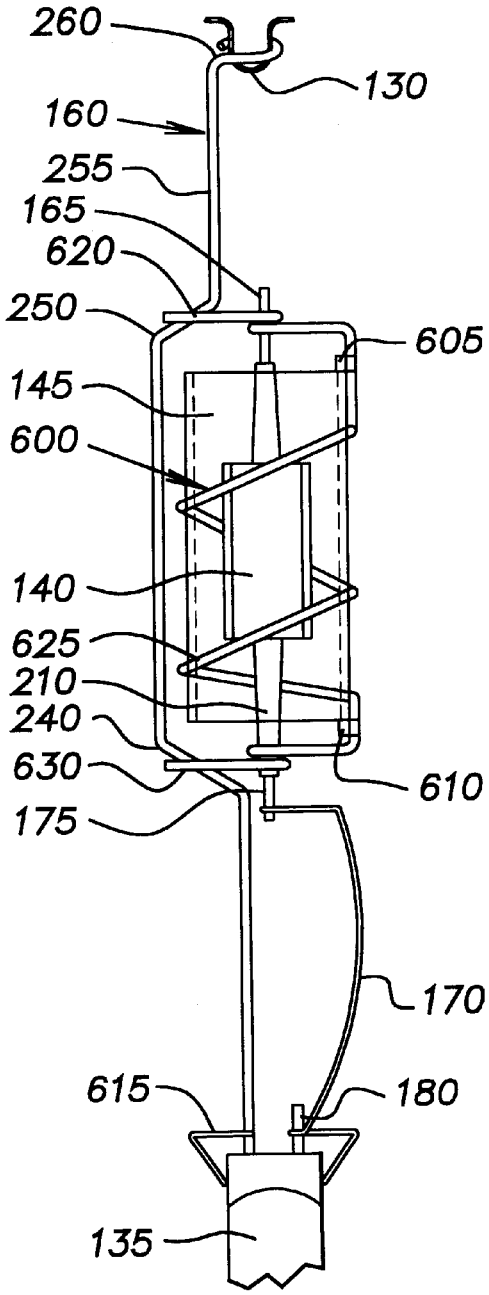
FIG. 6 shows an elevational view of a second embodiment of the mount assembly according to the present invention.

FIG. 6 depicts a second embodiment of a mount assembly according to the present invention. The mount assembly includes the arc tube 140 and shroud 145 subassembly, the non-insulated main conductor wire 160, and the second conductor wire 170. The mount assembly may also include a getter 615.

The arc tube 140 and shroud 145 subassembly includes the arc tube 140, the shroud 145, a center support wire 600 and upper and lower support stops 605 and 610. The upper and lower stops 605 and 610 may be attached to or formed from the center support wire 600. The getter 615 may be attached to the non-insulated main conductor wire 160 and the stem lead 180 near the stem 135. The getter may be barium based. The getter 615 may also be zirconium based and located above the shroud and arc tube assembly, as seen in FIG. 1.

The center support wire 600 is formed of three portions and is preferably a continuous wire. An upper lateral portion 620 is electrically connected to the upper electrode lead 165 in any number of manners. For example, the upper lateral portion 620 may be welded or crimped to the upper electrode lead 165. The upper lateral portion 620 may also generally encircle the upper electrode lead 165, as shown in FIG. 6.

A second or spiral portion 625 of a sufficient diameter generally encircles the shroud 145. Attached to the center support wire 600 between the upper lateral portion 620 and the spiral portion 625 is the upper support stop 605 which prevents the shroud 145 from moving axially in the upward direction. A lower lateral portion 630 mechanically attaches to an electrical insulator as the lower end of the arc tube to prevent an electrical connection between the lower electrode lead 175 and the center support wire 600. For example, the lower lateral portion 630 generally encircles the lower leg portion 210 of the arc tube 140, as shown in FIG. 6. Attached to the center support wire 600 between the spiral portion 625 and the lower lateral portion 630 is the lower support stop 610 which prevents the shroud from moving axially in the downward direction.

The center support wire 600 preferably attaches to the non-insulated main conductor wire 160 at the slanted inward 250 and slanted outward 240 portions of the non-insulated main conductor wire 160 with welds. Together, the non-insulated main conductor wire 160, the center support wire 600 and the upper and lower support stops 605 and 610 generally locate the arc tube 140 coaxially and laterally within the shroud 145.

The arc tube 140 and shroud 145 subassembly is manufactured by first inserting the shroud 145 through the spiral portion 625 of the center support wire 600 until the shroud 145 rests between the upper and lower support stops 605 and 610. The arc tube 140 is inserted into the shroud 145 such that the upper and lower electrode leads 165 and 175 extend through the shroud 145 at the respective ends. The upper electrode lead 165 of the arc tube 140 is then secured to the upper lateral portion 620 of the center support wire 600 preferably with a weld. The lower lateral portion 630 of the center support wire 600 is secured to the lower leg portion 210 of the arc tube 140 in any number of manners as long as an electrical connection between the lower electrical lead 175 and the non-insulated main conductor wire 160 is prevented. For example, the lower lateral portion 630 of the center support wire 600 may wrap around the lower leg portion 210 of the arc tube 140.

The center support wire 600 is attached to the non-insulated main conductor wire 160 at a connection point below and a connection point above the shroud 145 to form the mount assembly. Preferably, the center support wire 600 is secured with welds to the slanted inward and outward portions 250 and 240 of the non-insulated main conductor wire 160, as shown in FIG. 6. The non-insulated main conductor wire 160 passes through the stem 135. The non-insulated main conductor wire 160 may also be coupled to a second stem lead which passes through the stem 135. As previously described in connection with the first embodiment of the electric lamp 100, the lower electrode lead 175 is electrically connected to the stem lead 180 by welding the second conductor wire 170 between the stem lead 180 and lower electrode lead 175. This connection may also be accomplished by directly connecting the lower electrode lead 175 to the stem lead 180 with a weld. The mount assembly is thereafter inserted into the outer envelope 105 through the inner diameter of the neck portion 125 and sealed to the outer envelope 105.

Figure 7:
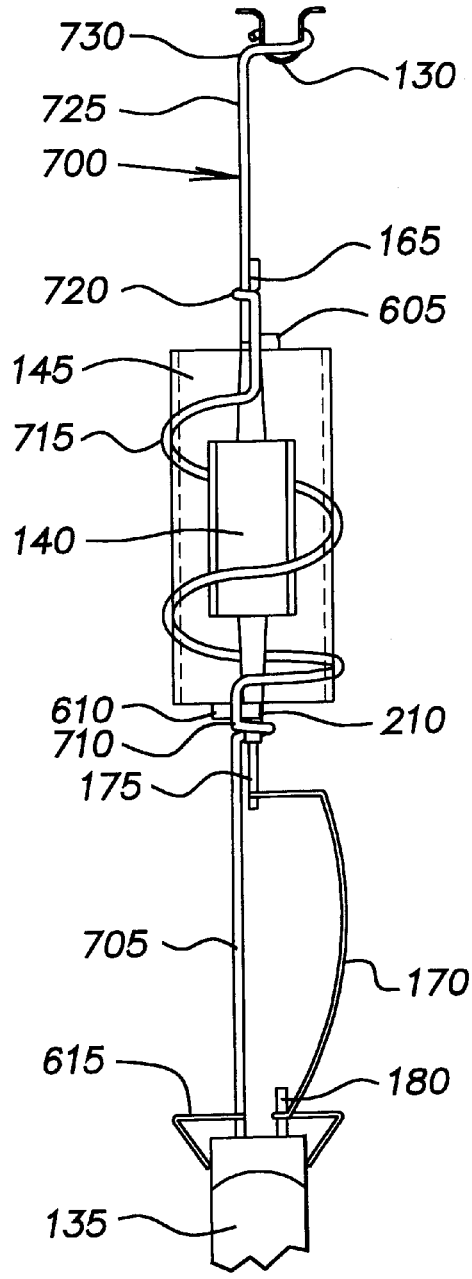
FIG. 7 shows an elevational view of a third embodiment of the mount assembly according to the present invention.
Figure 8:
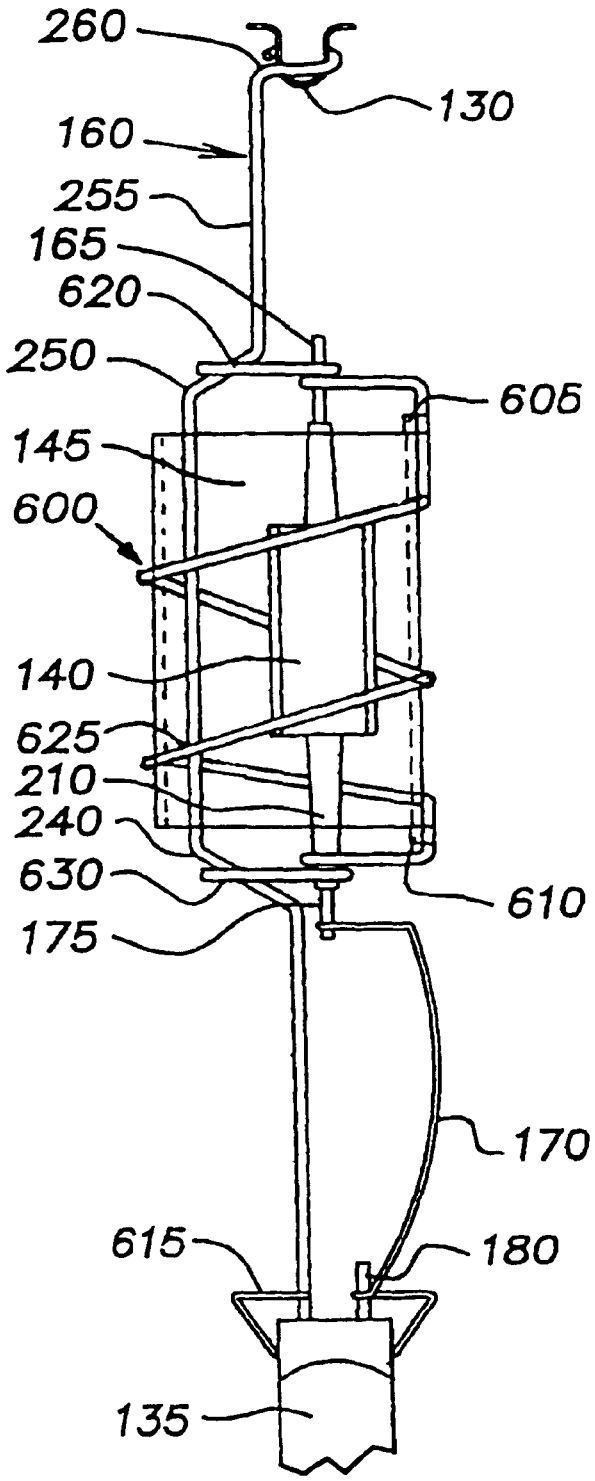
FIG. 8 shows an elevational view of another inventive embodiment of the mount assembly.

FIG. 7 depicts a third embodiment of a mount assembly according to the present invention. The mount assembly comprises the same elements as the second embodiment depicted in FIG. 6, with three exceptions. First, the non-insulated main conductor wire is of a different configuration. Second, the center support wire is omitted. Third, because the center support wire is omitted, the upper and lower support stops 605 and 610 are attached to or formed from the non-insulated main conductor wire. Thus, only the non-insulated main conductor wire, together with the upper and lower support stops 605 and 610, generally locate the arc tube 140 coaxially and laterally within the shroud 145 in this embodiment.

In FIG. 7, the non-insulated main conductor wire 700 is formed of five portions and surrounds the shroud 145. A lower axial portion 705 extends through the stem 135. A lower lateral portion 710 is mechanically attached to an electrical insulator at the lower end of the arc tube 140. For example, as shown in FIG. 7, the lower lateral portion 710 generally encircles the lower leg portion 210 of the arc tube 140. A spiral portion 715 generally encircles or surrounds the shroud 145. An upper lateral portion 720 is mechanically attached to the upper electrode lead 165. As shown in FIG. 7, the upper lateral portion encircles the upper electrode lead 165 and makes an electrical connection. While the electrical connection is preferably accomplished with a weld, it can be accomplished in other known manners, such as by crimping the upper lateral portion 720 of the non-insulated main conductor wire 700 to the upper electrode lead 165. An upper axial portion 725 extends to the upper end of the outer envelope 105. Preferably, a terminal loop 730 generally encircles the dimple 130 of the outer envelope 105 to limit movement of the arc tube 140 and the shroud 145 within the outer envelope 105 and improve rigidity of the entire assembly.

The arc tube 140 and shroud 145 mount assembly is manufactured by first inserting the shroud 145 through the spiral portion 715 of the non-insulated main conductor wire 700 until the shroud 145 rests between the upper and lower support stops 605 and 610. The arc tube 140 is inserted into the shroud such that the electrode leads 165 and 175 extend through the shroud. The upper electrode lead 165 of the arc tube 140 is then secured to the non-insulated main conductor wire 700 and makes an electrical connection. For example, the upper lateral portion 720 generally encircles the upper electrode lead 165, as shown in FIG. 7. The lower lateral portion 710 of the non-insulated main conductor wire 700 generally encircles and secures to the lower leg portion 210 of the arc tube 140, thereby preventing an electrical connection between the lower electrode lead 175 and the non-insulated main conductor wire 700. The lower end of the arc tube 140 may be attached to the non-insulated main conductor wire 700 in any number of other manners as long as there is no electrical connection between the non-insulated main conductor wire 700 and the lower electrode lead 175. The non-insulated main conductor wire 700 is then passed through the stem 135.

As in other embodiments of the electric lamp, the lower electrode lead 175 is electrically connected to the stem lead 180 by welding the second conductor wire 170 to the stem lead 180 and lower electrode lead 175. This connection may also be accomplished by directly connecting the lower electrode lead 175 to the stem lead 180 with a weld. The mount assembly is thereafter inserted into the outer envelope 105 through the inner diameter of the neck portion 125 and sealed to the outer envelope 105. This lamp construction requires fewer components.

In summary, the present invention provides an improved electric lamp which addresses the above noted problems found in prior art lamps. The present invention provides an easier and more cost efficient lamp construction. The invention reduces the overall complexity of the assembly and provides a method for modular assembly of a metal halide lamp. The lamp also takes advantage of the fact that the passage of sodium through alumina ceramic arc tubes is suppressed by several orders of magnitude relative to quartz.

This lamp construction has a number of advantages over the prior art. The number of parts and welds required in this improved electric lamp are reduced by both electrically coupling and mechanically supporting a shroud and arc tube utilizing only the non-insulated main conductor wire and upper and lower center supports. No additional support frame is needed.

Still another advantage is realized since the lamp construction removes the need for complex shroud assemblies.

Yet another advantage of this improved lamp assembly is that manufacturing is simpler because it provides for a modular assembly of the shroud and arc tube.

Furthermore, since numerous modifications and variations will readily occur to those skilled in the art, it is not desired that the present invention be limited to the exact construction and operation illustrated and described herein. Accordingly, all suitable modifications and equivalents which may be resorted to are intended to fall within the scope of the claims.

What is claimed is:

1. An electric lamp comprising:

(a) a sealed light-transmissive outer envelope having an interior space;

(b) a base fixed to the outer envelope;

(c) a non-insulated main conductor wire within the outer envelope and connected to the base at one end;

(d) a light source capable of generating light within the outer envelope, the light source having first and second ends, the first end being electrically coupled to the non-insulated main conductor wire and the second end coupled to a stem lead;

(e) a shroud surrounding the light source, the shroud mounted adjacent the non-insulated main conductor wire; and (f) a first center support that (i) electrically connects the first end of the light source to the non-insulated main conductor wire, (ii) supports the shroud and the light source, and (iii) mechanically couples the shroud and the light source to the non-insulated main conductor wire.

2. The lamp of claim 1, wherein the light source is an arc tube.

3. The lamp of claim 1, wherein the light source is a ceramic arc tube.

4. The lamp of claim 1, wherein the shroud surrounds the non-insulated main conductor wire.

5. The lamp of claim 1, wherein the non-insulated main conductor wire is located outside of the shroud.

6. The lamp of claim 1, wherein the electric lamp is a metal halide arc discharge lamp.

7. The lamp of claim 1, wherein the non-insulated main conductor wire is continuous from the base to a dimple.

8. An electric lamp comprising:

(a) a sealed light-transmissive outer envelope having an interior space;

(b) a base fixed to the outer envelope;

(e) a non-insulated main conductor wire within the outer envelope and connected to the base at one end;

(d) a light source capable of generating light within the outer envelope, the light source having first and second ends, the first end being electrically coupled to the non-insulated main conductor wire and the second end coupled to a stem lead;

(e) a shroud surrounding the light source, the shroud mounted adjacent the non-insulated main conductor wire;

(f) a first center support that electrically connects the first end of the light source to the non-insulated main conductor wire, supports the shroud and the light source, and mechanically couples the shroud and the light source to the non-insulated conductor wire; and, (g) a second center support, the second center support mechanically coupling the non-insulated main conductor wire to the shroud and an electric insulator at the second end of the light source and being electrically insulated from an electric lead emanating from a second end of the light source.

9. The lamp of claim 8, wherein the light source, the shroud, and the first and second center supports form an integral unit.

10. The lamp of claim 8, wherein the electric insulator is a non-electrical conducting portion of the second end of the light source.

11. An electric lamp comprising:

(a) a sealed light-transmissive outer envelope having an interior space;

(b) a base fixed to the outer envelope;

(c) a non-insulated main conductor wire within the outer envelope and connected to the base at one end;

(d) a light source capable of generating light within the outer envelope, the light source having first and second ends, the first end being electrically coupled to the non-insulated main conductor wire and the second end coupled to a stem lead;

(e) a shroud surrounding the light source, the shroud mounted adjacent the non-insulated main conductor wire; and (f) a center support wire that (i) is connected to a first lead emanating from the first end of the light source, (ii) encircles the shroud in a spiral fashion, (iii) is attached to the non-insulated main conductor wire at a first connection point above the shroud and at a second connection point below the shroud, and (iv) is continuous from the first connection point to the second connection point.

12. The lamp of claim 11, further comprising stops connected to the center support wire which prevent the shroud from moving in an axial direction.

13. An electric lamp comprising:

(a) a sealed light transmissive outer envelope having an interior space;

(b) a base fixed to the outer envelope;

(c) a light source capable of generating light within the outer envelope, the light source having first and second ends, the first end being electrically coupled to the main conductor wire and the second end coupled to a stem lead; and (d) a non-insulated main conductor wire within the outer envelope and connected to the base at one end, the non-insulated main conductor wire being mechanically and electrically coupled to the first end of the light source, mechanically attached to an electric insulator at the second end of the light source, and electrically insulated from an electric lead emanating from a second end of the light source;

(e) a shroud surrounding the light source and surrounded by the non insulated main conductor wire.

14. The lamp of claim 13, wherein the non-insulated main conductor wire supports the shroud.

15. The lamp of claim 13, wherein the non-insulated main conductor wire is mechanically attached to a first lead emanating from the first end of the light source.

16. The lamp of claim 13, further comprising stops connected to the non-insulated main conductor wire which prevent the shroud from moving in an axial direction.

* * * * *